US008050445B2

(12) United States Patent
Kim et al.

(10) Patent No.: US 8,050,445 B2
(45) Date of Patent: Nov. 1, 2011

(54) MICROSPEAKER AND METHOD OF DESIGNING THE SAME

(75) Inventors: Woo-Chul Kim, Suwon-si (KR); Yoon-Young Kim, Seoul (KR)

(73) Assignee: Seoul National University Industry Foundation, Seoul (KR)

( * ) Notice: Subject to any disclaimer, the term of this patent is extended or adjusted under 35 U.S.C. 154(b) by 1145 days.

(21) Appl. No.: 11/826,097

(22) Filed: Jul. 12, 2007

(65) Prior Publication Data

US 2008/0170745 A1 Jul. 17, 2008

(30) Foreign Application Priority Data

Jan. 16, 2007 (KR) ..... 10-2007-0004875

(51) Int. Cl.
*H04R 11/02* (2006.01)

(52) U.S. Cl. ..... 381/412; 381/421; 381/422

(58) Field of Classification Search ..... 381/412–422
See application file for complete search history.

(56) References Cited

U.S. PATENT DOCUMENTS 6,904,158 B1 * 6/2005 Ohashi ..... 381/401

FOREIGN PATENT DOCUMENTS

| | | |
|---|---|---|
| KR | 100185946 B1 | 12/1998 |
| KR | 1020010089034 | 9/2001 |
| KR | 1020047083981 | 10/2004 |
| KR | 1020050091444 | 9/2005 |

* cited by examiner

*Primary Examiner* — Richard A. Booth

(74) *Attorney, Agent, or Firm* — The Nath Law Group; Jerald L. Meyer; Sung Yeop Chung

(57) ABSTRACT

Provided are a microspeaker and a method of designing the same. The microspeaker includes a first permanent magnet and a second permanent magnet disposed on the first permanent magnet with a predetermined gap therebetween, the first and second permanent magnets having opposite magnetization directions; a third permanent magnet and a fourth permanent magnet disposed on the third permanent magnet with a predetermined gap therebetween, the third and fourth permanent magnets being disposed next to the first and second permanent magnets, respectively, with an air gap therebetween; a yoke interposed between the first and second permanent magnets and between the third and fourth permanent magnets; a voice coil inserted into the air gap; and a vibrating diaphragm attached to an end of the voice coil and forming a sound field according to the movement of the voice coil, wherein the first and third permanent magnets have opposite magnetization directions, and the second and fourth permanent magnets have opposite magnetization directions.

6 Claims, 16 Drawing Sheets

MICROSPEAKER AND METHOD OF DESIGNING THE SAME

This application claims priority from Korean Patent Application No. 10-2007-0004875 filed on Jan. 16, 2007 in the Korean Intellectual Property Office, the disclosure of which is incorporated herein by reference in its entirety.

BACKGROUND OF THE INVENTION

1. Field of the Invention

The present invention relates to a microspeaker and a method of designing the same, and more particularly, to a microspeaker having a high sound pressure level (SPL) and a broad frequency range by using multi-polar permanent magnets which have different magnetization directions and a vibrating diaphragm which has a ferromagnetic material and a multi-layer structure, and a method of designing the microspeaker.

2. Description of the Related Art

Speakers convert electrical signals into voice signals and are applied in various sound devices. In particular, speakers loaded into small-sized sound devices, such as earphones, mobile phones and MP3 players, are called microspeakers.

In order to enhance the performance of a microspeaker, it is required to increase the sound pressure level (SPL) of the microspeaker and broaden the frequency range thereof.

FIG. 1 illustrates a perspective view of and a perspective cross-sectional view of a conventional microspeaker. The microspeaker is formed of a permanent magnet, a yoke, a voice coil, and a vibrating diaphragm.

FIG. 2 is a design model used to analyze the magnetic flux distribution of the microspeaker of FIG. 1 using ANSYS. FIG. 3 illustrates the flow of magnetic flux according to the design model of FIG. 2.

Since the microspeaker is axially symmetrical, the design model illustrated in FIG. 2 is set for half of the region of the microspeaker with respect to a central axis. The yoke collects magnetic flux generated by the permanent magnet and directs the collected magnetic flux toward the voice coil. Referring to FIG. 3, the magnetic flux flows in a direction crossing the voice coil. Powered by current that flows through the voice coil and the magnetic flux that passes through the voice coil, the voice coil moves up and down in a rotational axis direction. In this case, the intensity of a magnetic field, which crosses the voice coil, in a section having a Z value of 5.6 mm through 6.4 mm in FIG. 3 is related to the SPL of the microspeaker. Conventionally, a single permanent magnet ($+Me_z$) in which magnetic flux flows in one direction has been only used.

In addition, it is required to broaden the frequency range of the microspeaker in order to enhance the performance thereof.

SUMMARY OF THE INVENTION

The present invention provides a microspeaker designed and manufactured to include a magnetic circuit using multi-polar permanent magnets, which have different magnetization directions, and a vibrating diaphragm having a multi-layer structure that includes a ferromagnetic material in order to increase the sound pressure level (SPL) of the microspeaker and broaden the frequency range thereof.

However, the objectives of the present invention are not restricted to the one set forth herein. The above and other objectives of the present invention will become more apparent to one of daily skill in the art to which the present invention pertains by referencing a detailed description of the present invention given below.

According to an aspect of the present invention, there is provided a microspeaker including a first permanent magnet and a second permanent magnet disposed on the first permanent magnet with a predetermined gap therebetween, the first and second permanent magnets having opposite magnetization directions; a third permanent magnet and a fourth permanent magnet disposed on the third permanent magnet with a predetermined gap therebetween, the third and fourth permanent magnets being disposed next to the first and second permanent magnets, respectively, with an air gap therebetween; a yoke interposed between the first and second permanent magnets and between the third and fourth permanent magnets; a voice coil inserted into the air gap; and a vibrating diaphragm attached to an end of the voice coil and forming a sound field according to the movement of the voice coil, wherein the first and third permanent magnets have opposite magnetization directions, and the second and fourth permanent magnets have opposite magnetization directions.

According to another aspect of the present invention, there is provided a method of designing a microspeaker. The method includes (a) setting a topology optimization design domain of a magnetic circuit into which a voice coil is inserted; and (b) setting two permanent magnets having opposite magnetization directions and a yoke as design variables of the design domain and performing topology optimization of the magnetic circuit so that a force acting on the voice coil in an axial direction is maximized by magnetic flux which is generated by the permanent magnets and current which flows through the voice coil.

BRIEF DESCRIPTION OF THE DRAWINGS

The above and other features and advantages of the present invention will become more apparent by describing in detail preferred embodiments thereof with reference to the attached drawings in which.

DETAILED DESCRIPTION OF THE INVENTION

Figure 1:
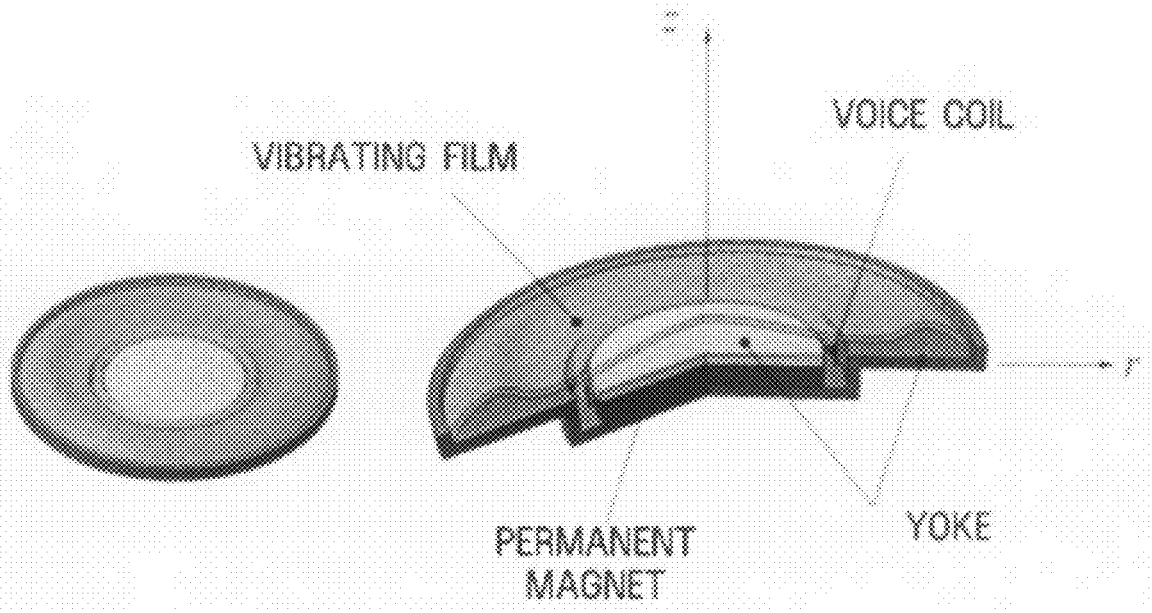
FIG. 1 (PRIOR ART)
FIG. 1 illustrates a perspective view of and a perspective cross-sectional view of a conventional microspeaker.

The present invention will now be described more fully with reference to the accompanying drawings, in which exemplary embodiments of the invention are shown. The invention may, however, be embodied in many different forms and should not be construed as being limited to the embodiments set forth herein; rather, these embodiments are provided so that this disclosure will be thorough and complete, and will fully convey the concept of the invention to those skilled in the art. Like reference numerals in the drawings denote like elements, and thus their description will be omitted.

A microspeaker and a method of designing the same according to the present invention will hereinafter be described in detail with reference to the accompanying drawings.

Figure 4:
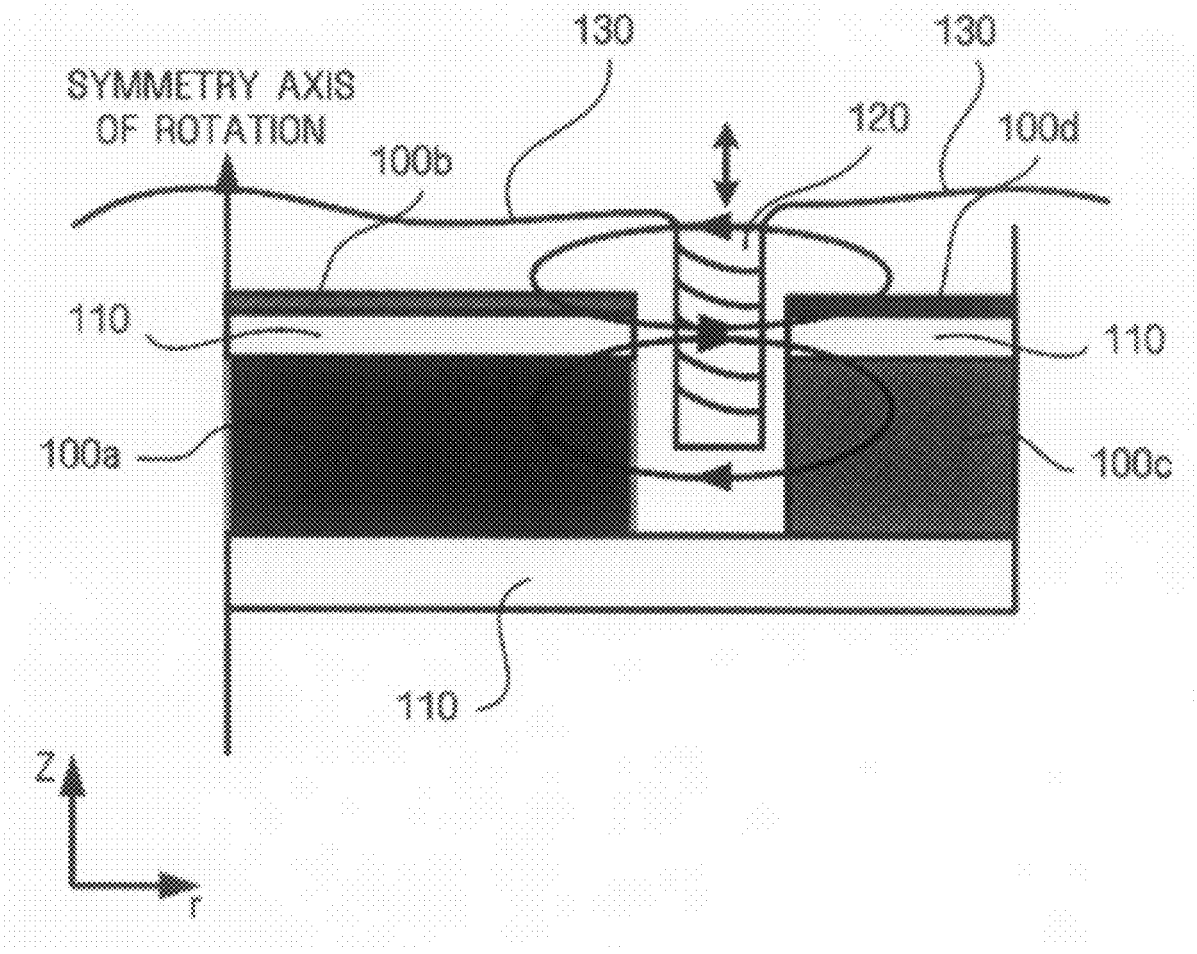
FIG. 4 is a schematic diagram illustrating a magnetic circuit of a microspeaker according to an embodiment of the present invention.

FIG. 4 is a schematic diagram illustrating a magnetic circuit of a microspeaker according to an embodiment of the present invention.

Referring to FIG. 4, the microspeaker includes first through fourth permanent magnets 100*a* through 100*d*, a yoke 110, a voice coil 120, and a vibrating diaphragm 130.

The first through fourth permanent magnets 100*a* through 100*d* generate magnetic flux and cause the generated magnetic flux to pass through the voice coil 120. The first through fourth permanent magnets 100*a* through 100*d* may have different magnetization directions. In the present invention, if ring-type permanent magnets are to be used, permanent magnets which are magnetized in +, − and Z directions will be considered due to the limitations of magnetization technology.

The first permanent magnet 100*a* is separated from the second permanent magnet 100*b* by a predetermined gap, and the yoke 110 is interposed between the first and second permanent magnets 100*a* and 100*b*. The first permanent magnet 100*a* and the second permanent magnet 100*b* above the first permanent magnet 100*a* are magnetized in opposite directions. Therefore, the first and second permanent magnets 100*a* and 100*b* magnetized in the opposite directions generate a large amount of magnetic flux, and the yoke 110 interposed between the first and second permanent magnets 100*a* and 100*b*, which are magnetized in the opposite directions, concentrates the generated magnetic flux on the voice coil 120. The third and fourth permanent magnets 100*c* and 100*d* are formed next to the first and second permanent magnets 100*a* and 100*b*, respectively, with an air gap therebetween. The yoke 110 is also interposed between the third and fourth permanent magnets 100*c* and 100*d*. The magnetization direction of the third permanent magnet 100*c* is opposite to that of the first permanent magnet 100*a*. That is, the magnetization direction of the third permanent magnet 100*c* is identical to that of the second permanent magnet 100*b*. In addition, the magnetization direction of the fourth permanent magnet 100*d* is opposite to that of the second permanent magnet 100*b*. That is, the magnetization direction of the fourth permanent magnet 100*d* is identical to that of the first permanent magnet 100*a*. Therefore, the yoke 110 interposed between the third and fourth permanent magnets 100*c* and 100*d*, which are magnetized in opposite directions, further concentrates the magnetic flux generated by the first and second permanent magnets 100*a* and 100*b* on the voice coil 120 without a leakage of the magnetic flux.

Consequently, a magnetic flux path as indicated by an arrow in FIG. 4 is formed by the first through fourth permanent magnets 100*a* through 100*d*. The yoke 110 interposed between the first through fourth permanent magnets 100*a* through 100*d* collects magnetic flux and directs the collected magnetic flux toward the voice coil 120.

As described above, the yoke 110 is interposed between the first and second permanent magnets 100*a* and 100*b* and between the third and fourth permanent magnets 100*c* and 100*d* and collects magnetic flux so that a large amount of magnetic flux penetrates through the voice coil 120. As illustrated in FIG. 4, the yoke 110 may also be formed under the first and third permanent magnets 100*a* and 100*c*.

The voice coil 120 is inserted into the air gap between the first and third permanent magnets 100*a* and 100*c* and between the second and fourth permanent magnets 100*b* and 100*d*. The vibrating diaphragm 130 is attached to an end of the voice coil 120 and moves according to the movement of the voice coil 120, thereby forming a sound field. When current is applied to the voice coil 120, the voice coil 120 vibrates in a vertical direction by the magnetic flux that flows through the voice coil 120. Accordingly, the vibrating diaphragm 130 attached to the voice coil 120 moves.

As described above, the vibrating diaphragm 130 is connected to the end of the voice coil 120, vibrates as the voice coil 120 moves up and down, and thus forms a sound field. Generally, the vibrating diaphragm 130 is formed of poly ethylene naphtalate (PEN) or polyetherimide (PEI). The vibrating diaphragm 130 may be formed of a ferromagnetic material and have a multi-layer structure. If the vibrating diaphragm 130 is formed of a ferromagnetic material and has a multi-layer structure, the microspeaker can have a higher sound pressure level (SPL) and a broader frequency range, which will be described later. The ferromagnetic material may be nickel (Ni), iron (Fe), or cobalt (Co).

A method of designing a magnetic circuit of a microspeaker using a topology optimization design method according to the present invention and the result of applying the design method will now be described.

An SPL is linearly proportional to a magnetic exciting force. Therefore, if the intensity of magnetic flux, which penetrates through a voice coil, is increased, the SPL can be increased. A goal of designing a magnetic circuit is to maximize a force acting in a direction toward an axis of symmetry and minimize a force acting in a radial direction.

Figure 5:
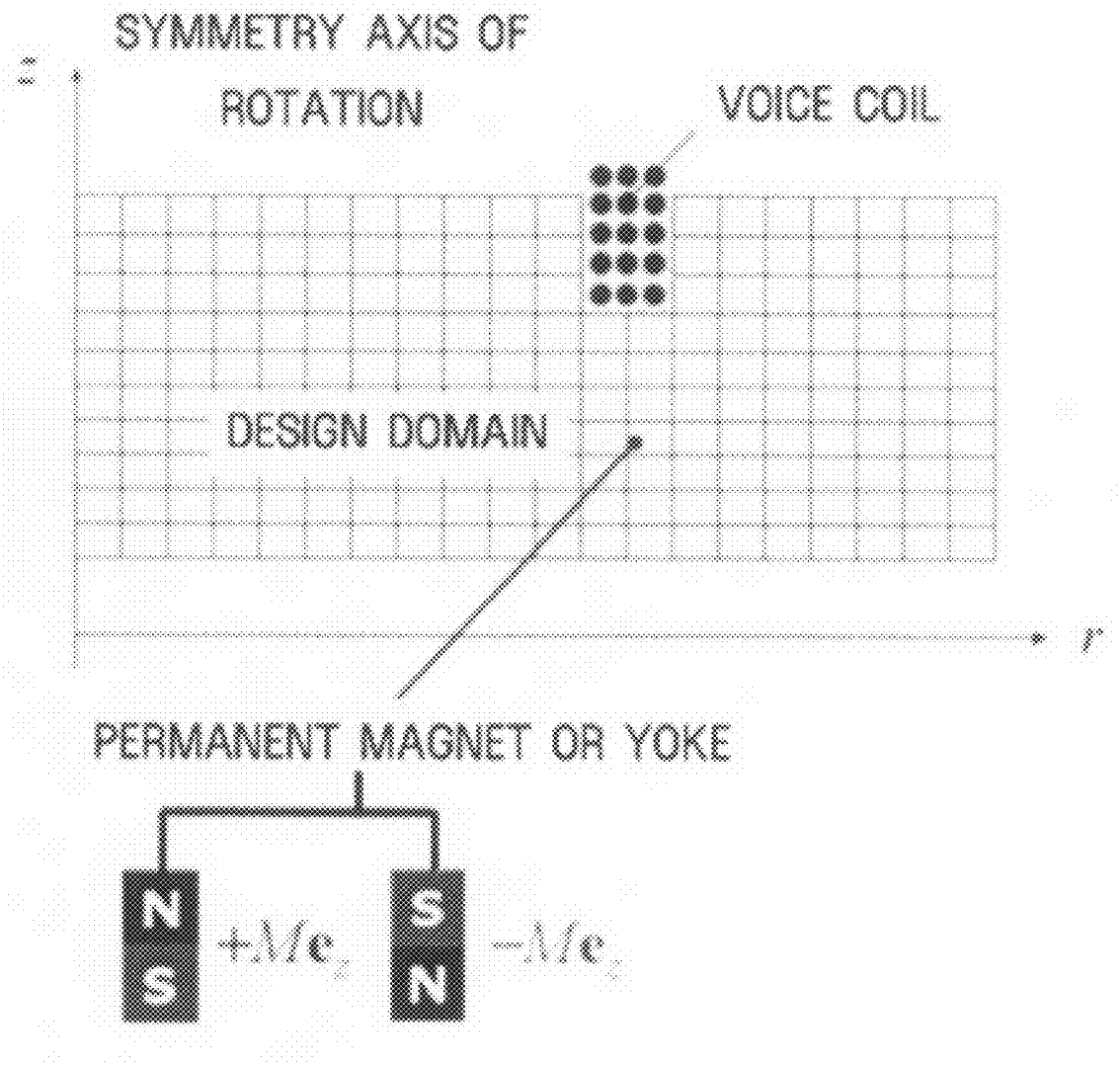
FIG. 5 illustrates a design domain for performing topology optimization of a magnetic circuit.
Figure 6:
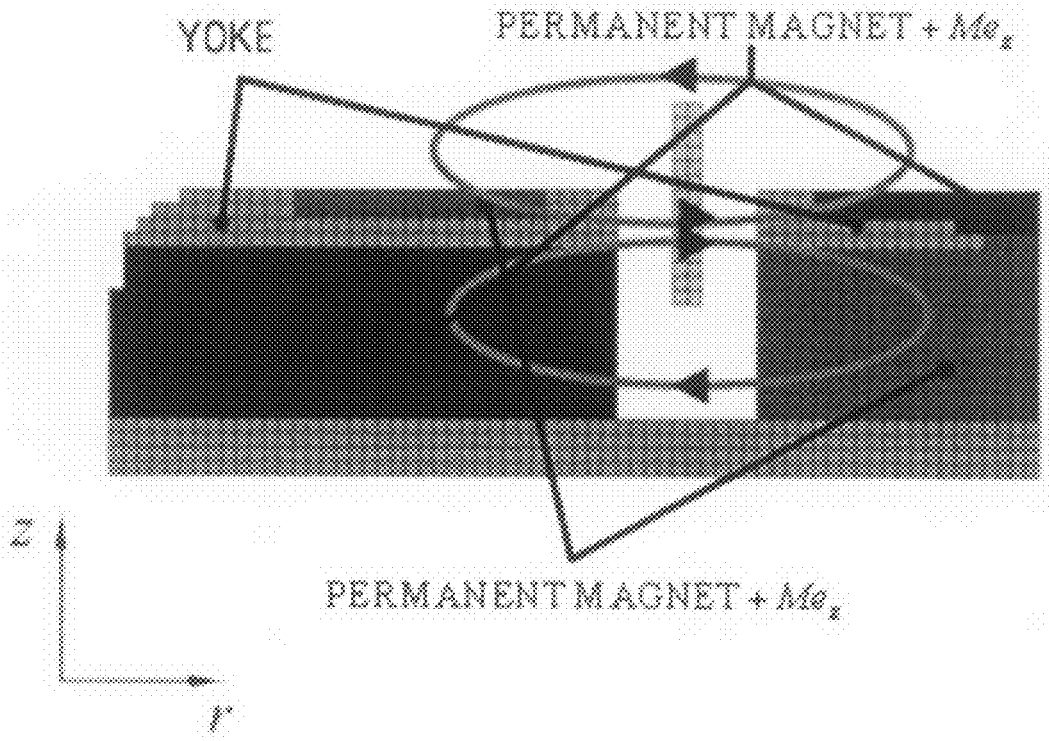
FIG. 6 illustrates the magnetic circuit whose topology in the design domain of FIG. 5 has been optimized.
Figure 7:
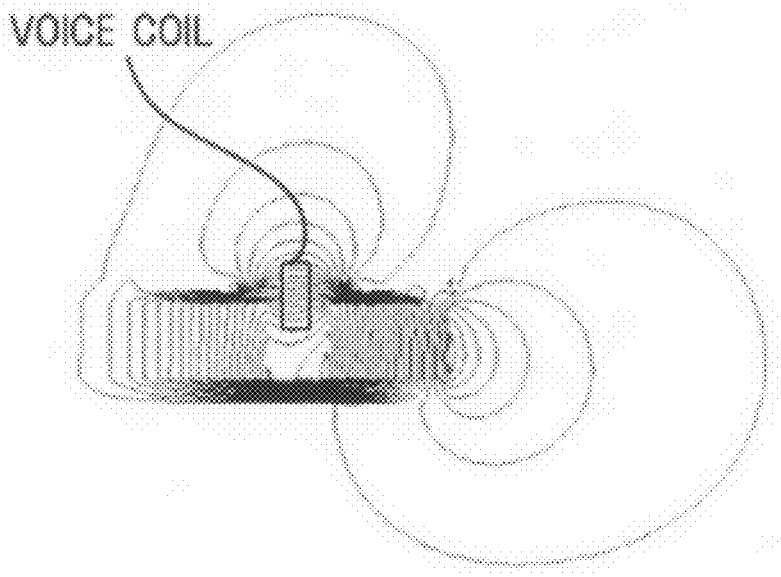
FIG. 7 illustrates the flow of magnetic flux by the magnetic circuit of FIG. 6.
Figure 8A:
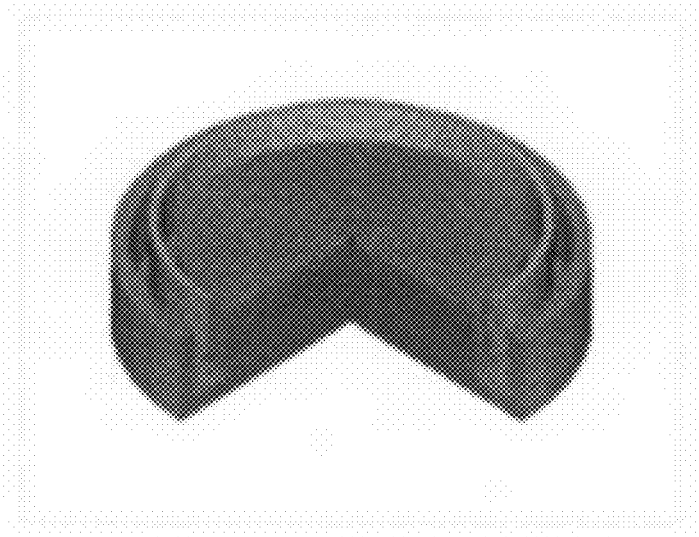
FIG. 8A illustrates a conventional microspeaker.
Figure 8B:
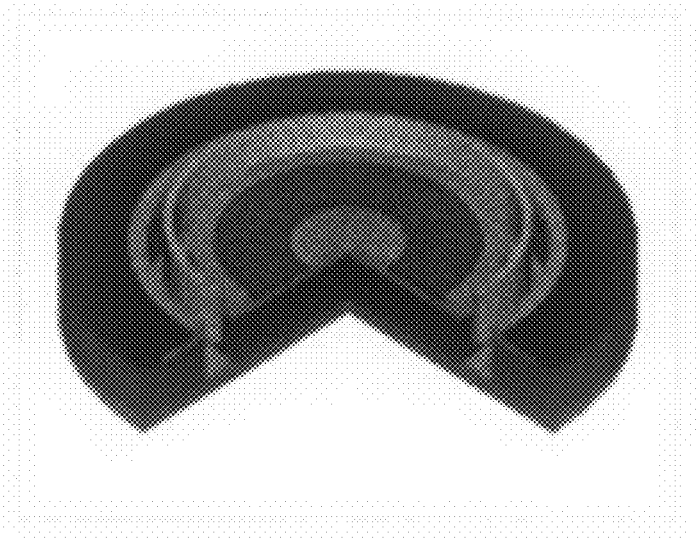
FIG. 8B illustrates a microspeaker including a magnetic circuit whose topology has been optimized according to the present invention.
Figure 8C:
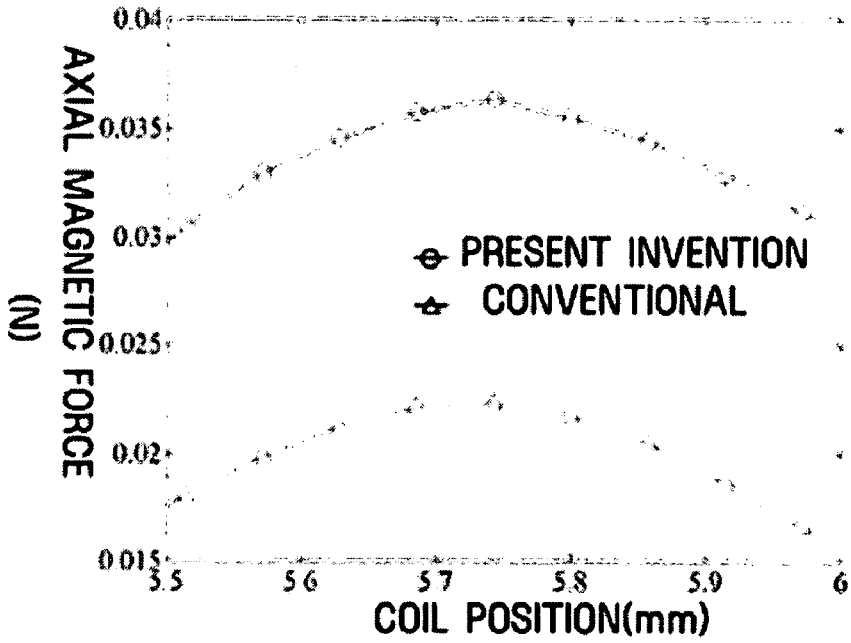
FIG. 8C is a graph comparing axial magnetic forces acting on voice coils of the microspeakers illustrated in FIGS. 8A and 8B, respectively.

FIG. 5 illustrates a design domain for performing topology optimization of a magnetic circuit. FIG. 6 illustrates the magnetic circuit whose topology in the design domain of FIG. 5 has been optimized. FIG. 7 illustrates the flow of magnetic flux by the magnetic circuit of FIG. 6. FIG. 8A illustrates a conventional microspeaker, FIG. 8B illustrates a microspeaker including a magnetic circuit whose topology has been optimized according to the present invention, and FIG. 8C is a graph comparing axial magnetic forces acting on voice coils of the microspeakers illustrated in FIGS. 8A and 8B, respectively.

FIG. 5 illustrates each element in the design domain for topology optimization. Referring to FIG. 5, a voice coil is inserted into the middle of the design domain. In each element, permanent magnets and a yoke are set as design variables. In the present invention, a signal permanent magnet in which magnetic flux flows in one direction is not used. Instead, multi-polar permanent magnets ($+Me_z$, $-Me_z$) having different magnetization directions are used as design variables. Here, M indicates the size of magnetization of a permanent magnet, and $e_z$ indicates a magnetization direction.

An objective function and a constraint equation of topology optimization for maximizing the SPL are given by Equation (1).

$$\Phi(\gamma, A) = \sum_{i=1}^{n_c} f_{zi} = J_{\theta i} \times B_{ri} \tag{1}$$

$$H(\gamma) = \sum_{i=1}^{n_c} f_{ri} \le \varepsilon (\varepsilon\text{: small value}).$$

In this case, a value of the objective function $\phi$, which is a force acting in an axial direction, is maximized. In Equation (1), $n_c$ indicates the number of elements of a voice coil, $J_{\theta i}$ indicates current density of an $i^{th}$ element of the voice coil, $B_{ri}$ indicates magnetic flux density of the $i^{th}$ element of the voice coil, and $f_{zi}$ and $f_{ri}$ respectively indicate forces of the $i^{th}$ element of the voice coil which are acting in z and r directions.

Figure 2:
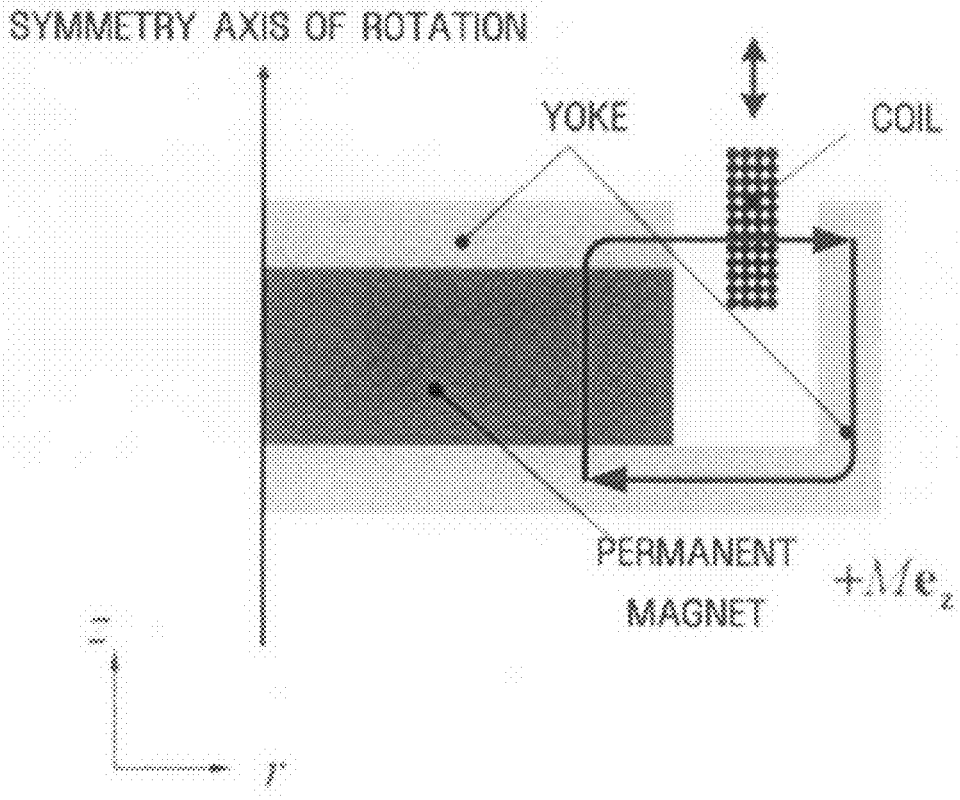
FIG. 2 (PRIOR ART)
FIG. 2 is a design model used to analyze the magnetic flux distribution of the microspeaker of FIG. 1 using ANSYS.
Figure 3:
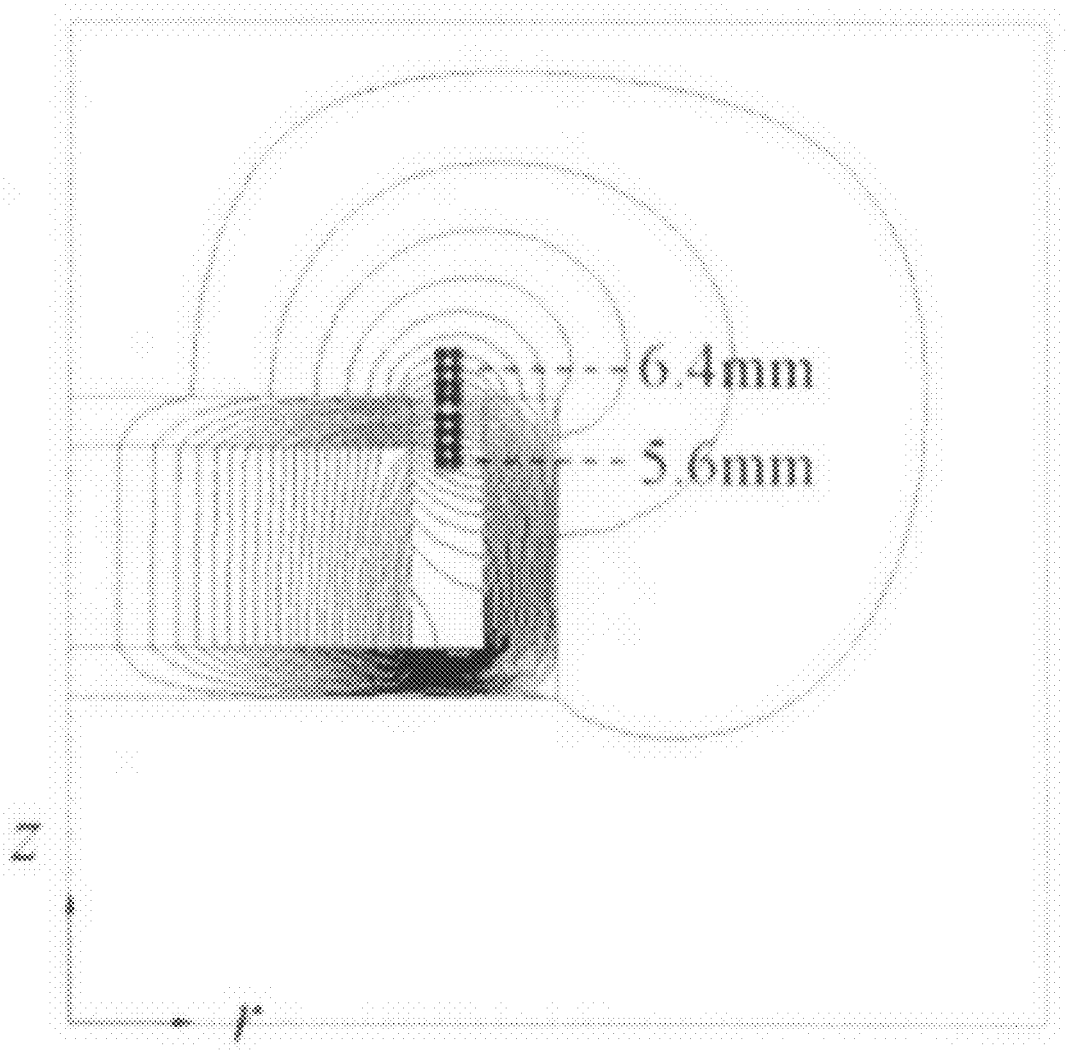
FIG. 3 (PRIOR ART)
FIG. 3 illustrates the flow of magnetic flux according to the design model of FIG. 2.

The results of topology optimization of the yoke and the permanent magnets when $\mu$ (yoke)=320000, $M=Me_z$=119040 A/m, and $n_c$=12 are illustrated in FIG. 6, and FIG. 7 illustrates the flow of magnetic flux. Unlike a conventional microspeaker, a microspeaker according to the present invention includes four permanent magnets. That is, two permanent magnets having opposite magnetization directions are disposed in a horizontal direction. In addition, another two permanent magnets having opposite magnetization directions are disposed in a vertical direction with a yoke interposed therebetween. The two permanent magnets on the left, which have opposite magnetization directions, increase magnetic flux density in a direction toward the yoke, and the yoke concentrates most of the magnetic flux on the voice coil. In addition, the two permanent magnets on the right pull the magnetic flux generated by the permanent magnets on the left and thus increase the amount of magnetic flux that penetrates through the entire voice coil without the leakage of the magnetic flux. Therefore, while one magnetic flux path is formed in the conventional magnetic circuit as illustrated in FIG. 2, two magnetic flux paths are formed in the magnetic circuit according to the present invention as indicated by an arrow in FIG. 6. The two different magnetic flux paths increase the magnetic flux of the voice coil according to the present invention to become greater than that of the conventional voice coil. FIG. 8 compares the axial magnetic forces acting on the conventional voice coil and the voice coil according to the present invention. It can be understood from FIG. 8C that the axial magnetic force of the magnetic circuit according to the present invention is approximately 60% greater than that of the conventional magnetic circuit.

The shape optimization of a vibrating diaphragm may cause the microspeaker according to the present invention to have a higher SPL and a broader frequency range than the conventional microspeaker.

In this case, the vibrating diaphragm may be formed of PEN, and material properties of PEN are as follows.

| | |
|---|---|
| Thickness | 0.012 mm |
| Young's modulus | 7.46 Gpa |
| Damping ratio | 0.2 |
| Density | 1360 kg/m$^3$ |
| Poisson's ratio | 0.2 |

The goal of the shape optimization is to broaden the frequency range of the microspeaker according to the present invention and increase the SPL thereof as compared with those of the conventional microspeaker. An objective function and a constraint equation of shape optimization are given by Equation (2).

$$\Phi = \frac{f_1}{f_1^*} + \frac{f_2^*}{f_2}, (X = \{x_1, x_2, \ldots, x_{NP}\}^T) \tag{2}$$

$$[p(f_1, f_2, f_3, r)]^2 \ge A \times [p_0(f_1, f_2, f_3, r)]^2.$$

Figure 9:
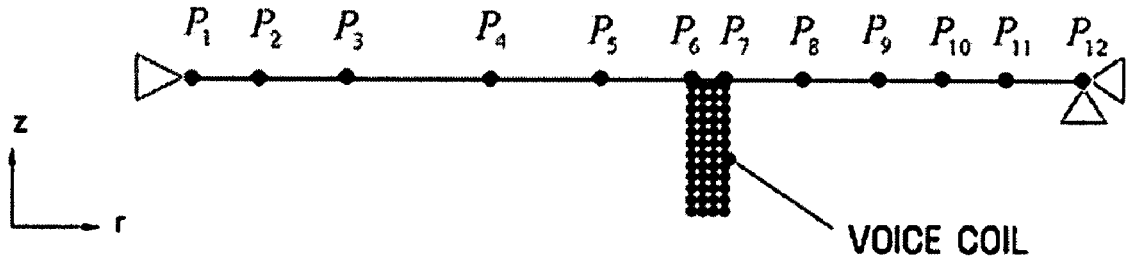
FIG. 9 illustrates interpolation points in a design domain for shape optimization according to an embodiment of the present invention.
Figure 10A:
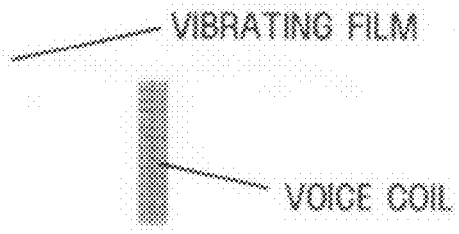
FIG. 10A illustrates an axially symmetrical model of a conventional microspeaker.
Figure 10B:
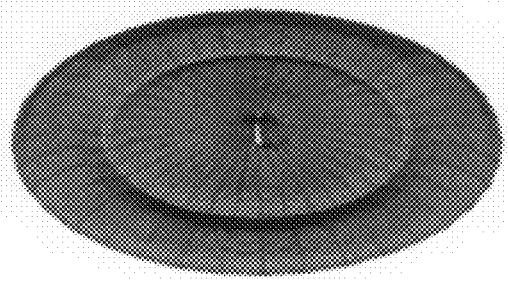
FIG. 10B is a perspective view of the microspeaker.

In this case, a value of the objective function $\phi$ is minimized. In Equation (2), $f_1^*$ and $f_2^*$ respectively indicate first and second natural frequencies of the conventional microspeaker. In order to minimize the value of the objective function $\phi$, a first natural frequency $f_1$ by shape optimization must be reduced, and a second natural frequency $f_2$ by shape optimization must be increased, thereby broadening the entire frequency range. In the above constraint equation, $p_0$ indicates the SPL of the conventional microspeaker, r indicates a measurement point vector, and $f_1$, $f_2$ and $f_3$ indicate exciting frequencies. This equation denotes a condition that the SPL of the microspeaker according to the present invention should be higher than the conventional microspeaker. In addition, the shape of the vibrating diaphragm is determined by a design variable vector X which is composed of interpolation points for the vibrating diaphragm. FIG. 9 illustrates interpolation points in a design domain for shape optimization according to an embodiment of the present invention. FIG. 9 illustrates only half of the axially symmetrical design domain. In FIG. 9, each of all interpolation points excluding two interpolation points on both ends of the design domain has two design variables (a horizontal direction r and a vertical direction z). The shape of a vibrating diaphragm is interpolated using a spline curve. Of the twelve interpolation points, the interpolation points $P_6$, $P_7$ and $P_{12}$ are fixed during shape optimization. In addition, the interpolation point $P_1$ moves only in the vertical direction. In this case, the initial shape of the vibrating diaphragm is determined to be the shape of the conventional vibrating diaphragm illustrated in FIG. 10, and the shape optimization of the vibrating diaphragm is performed accordingly.

Figure 11A:
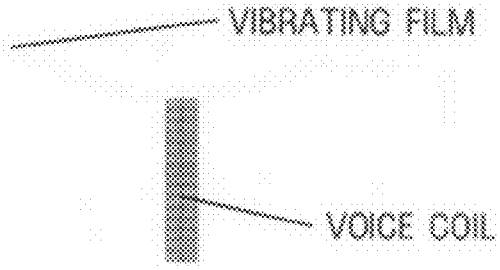
FIG. 11A illustrates an axially symmetrical model by shape optimization of a vibrating diaphragm according to an embodiment of the present invention.
Figure 11B:
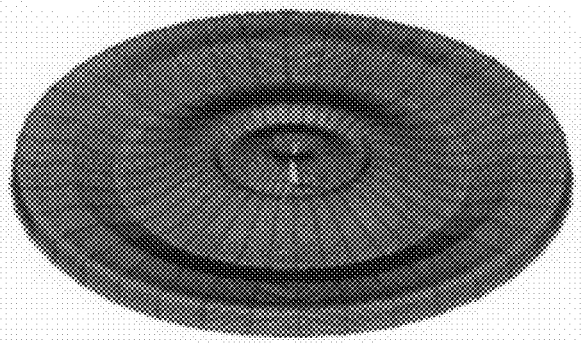
FIG. 11B is a perspective view of the vibrating diaphragm according to an embodiment of the present invention.
Figure 12A:
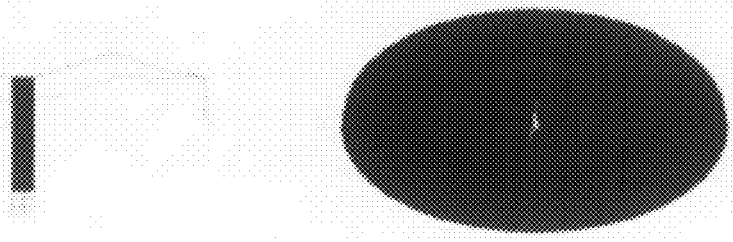
FIGS. 12A and 12B illustrate mode shapes of the shape-optimized vibrating diaphragm of FIG. 11 when the first natural frequency $f_1$=491.3534 Hz and when the second natural frequency $f_2$=11247.013 Hz, respectively.
Figure 12B:
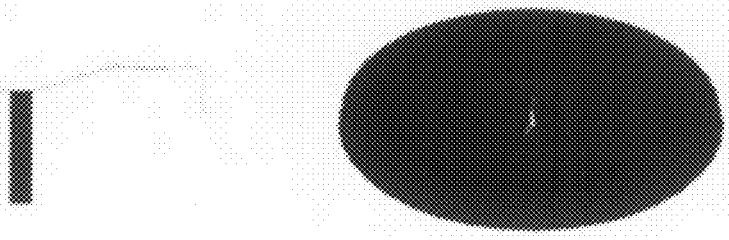
Figure 13A:
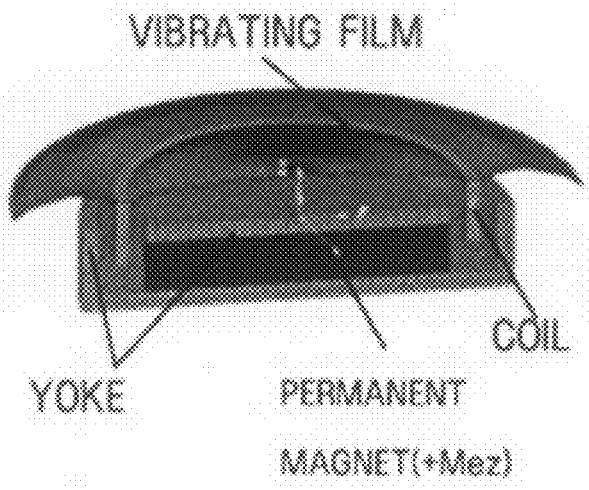
FIG. 13A is a perspective cross-sectional view of a conventional microspeaker.
Figure 13B:
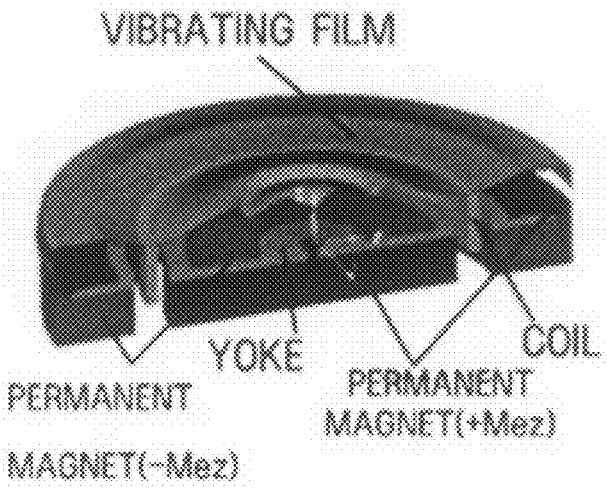
FIG. 13B is a perspective cross-sectional view of a microspeaker including a magnetic circuit whose topology has been optimized and a vibrating diaphragm whose shape has been optimized according to an embodiment of the present invention.

FIG. 11A illustrates an axially symmetrical model by shape optimization of a vibrating diaphragm according to an embodiment of the present invention, and FIG. 11B is a perspective view of the vibrating diaphragm according to an embodiment of the present invention. FIGS. 12A and 12B illustrate mode shapes of the shape-optimized vibrating diaphragm of FIG. 11 when the first natural frequency $f_1$=491.3534 Hz and when the second natural frequency $f_2$=11247.013 Hz, respectively. FIG. 13A is a perspective cross-sectional view of a conventional microspeaker, and FIG. 13B is a perspective cross-sectional view of a microspeaker including a magnetic circuit whose topology has been optimized and a vibrating diaphragm whose shape has been optimized according to an embodiment of the present invention. In addition, FIG. 13C is a graph comparing frequency ranges and SPLs of the conventional microspeaker and the microspeaker according to the present invention illustrated in FIGS. 13A and 13B.

FIG. 11 illustrates the vibrating diaphragm whose shape has been optimized. The following table compares natural frequencies of the conventional microspeaker with those of the microspeaker whose shape has been optimized as described above

| | Model Resonant Frequency (Hz) | |
|---|---|---|
| Mode | Conventional Vibrating Diaphragm | Optimized Vibrating Diaphragm |
| $f_1$ (First natural frequency) | 850.60 | 491.35 |
| $f_2$ (Second natural frequency) | 6595.95 | 11247.01 |

Figure 13C:
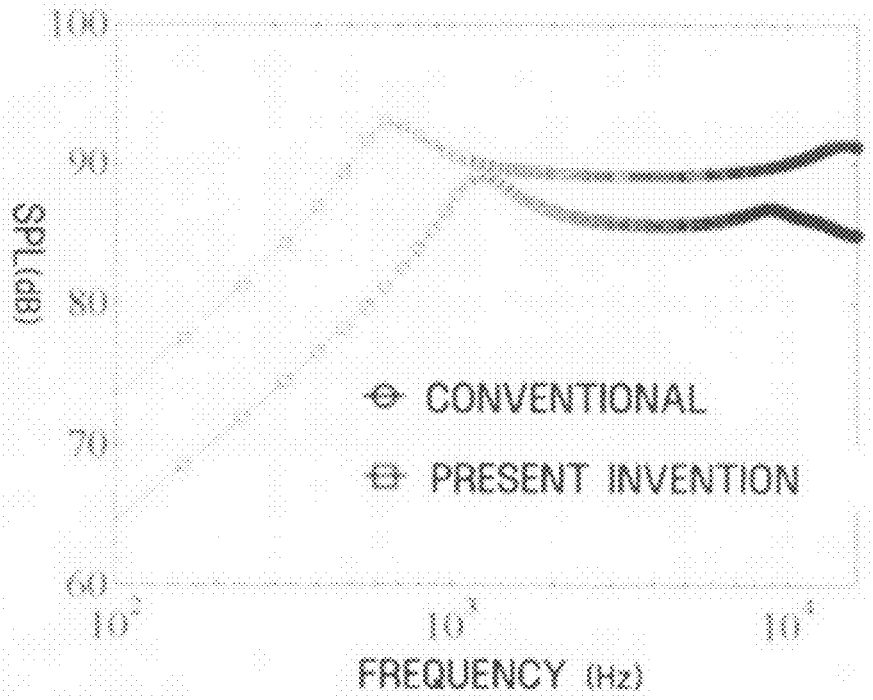
FIG. 13C is a graph comparing frequency ranges and sound pressure levels (SPLs) of the conventional microspeaker and the microspeaker according to the present invention illustrated in FIGS. 13A and 13B.

Referring to FIG. 13 and the above table, the first natural frequency was reduced by approximately 73%, and the second natural frequency was increased by approximately 70%. Consequently, the entire frequency bandwidth was increased by approximately 187%. The first and second natural frequencies respectively cause a side dome and a center dome of the vibrating diaphragm to move with respect to the voice coil as illustrated in FIG. 12. In addition, referring to the graph of FIG. 13C, the entire SPL was increased by approximately 10%. Therefore, it can be understood that the shape optimization of the vibrating diaphragm broadened the entire frequency range and increased the SPL.

If the vibrating diaphragm is formed to have a multi-layer structure, which includes a ferromagnetic material, using the topology optimization method, the performance of the microspeaker can further be enhanced. As described above, the topology optimization of the magnetic circuit has increased the SPL of the microspeaker, and the shape optimization of the vibrating diaphragm has broadened the frequency bandwidth of the microspeaker. In this state, if the vibrating diaphragm is formed to have a multi-layer structure including a ferromagnetic material, the SPL and frequency bandwidth of the microspeaker can further be increased at the same time. A ferromagnetic material is partially added to PEN or PEI of the vibrating diaphragm whose shape has been optimized. The ferromagnetic material may be any one of Ni, Fe, and Co. The following description will be made based on the assumption that the vibrating diaphragm is basically formed of PEN and that the ferromagnetic material added to PEN is Ni.

A multi-layered vibrating diaphragm may reduce the first natural frequency and increase the SPL due to its Ni. This is because the ferromagnetic material (Ni) generates an additional magnetic force due to electromagnetic induction by an external magnetic field. Therefore, the total magnetic force acting on the microspeaker is given by Equation (3).

$$F_{total}=F_{coil}+F_{Ni\text{-}diaphragm} \quad (3).$$

In order to increase the magnetic force and enhance frequency characteristics by adding Ni, that is, in order to have a broad frequency bandwidth between the first and second natural frequencies, the optimal distribution of Ni must be found.

Figure 14:
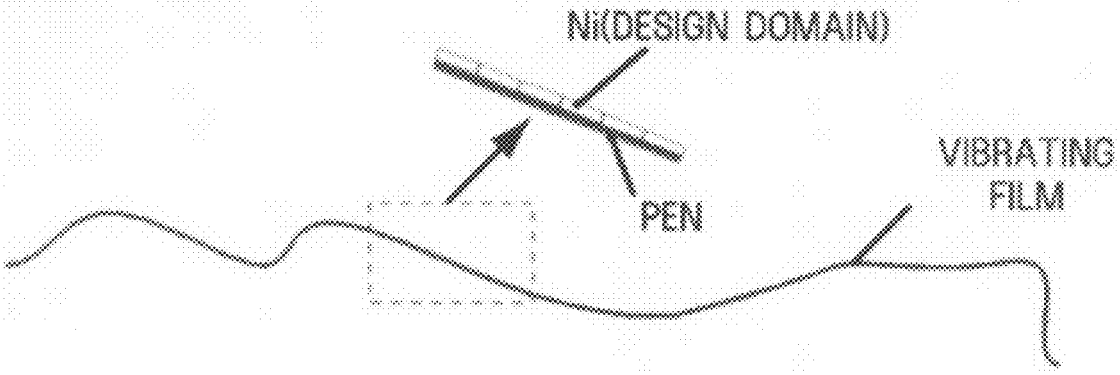
FIG. 14 illustrates a topology optimization design domain for designing a multi-layered vibrating diaphragm including a ferromagnetic material according to an embodiment of the present invention.

FIG. 14 illustrates a topology optimization design domain for designing a multi-layered vibrating diaphragm including a ferromagnetic material according to an embodiment of the present invention.

The vibrating diaphragm includes two layers formed of PEN and Ni. The first natural frequency $f_1$ is minimized in order for topology optimization of Ni distribution in the entire design domain. If the second natural frequency $f_2$ is reduced as the first natural frequency is reduced, the entire frequency bandwidth remains unchanged. Therefore, the second natural frequency $f_2$ must satisfy a condition of Equation (4) below.

$$f_2-f_2^*\geqq\delta_1, \quad (4)$$

where $f_2^*$ indicates the second natural frequency of the vibrating diaphragm whose shape has been optimized as described above, and $\delta_1$ indicates a value that maintains $f_2$ within a predetermined range. Assuming that $f_1^*$=491.35 Hz, $f_2^*$=11247.03 Hz, and $\delta_1$=50 Hz, topology optimization is performed using Ni having the following material properties.

| | |
|---|---|
| Material | Ni |
| Thickness | 0.012 mm |
| Young's modulus | 207 Gpa |
| Damping ratio | 0.2 |
| Density | 8900 kg/m$^3$ |
| Poisson's ratio | 0.31 |
| Electric resistivity | 6.4 * 10^-6 Ω-cm |
| Magnetic permeability | 1240 |

Figure 15A:
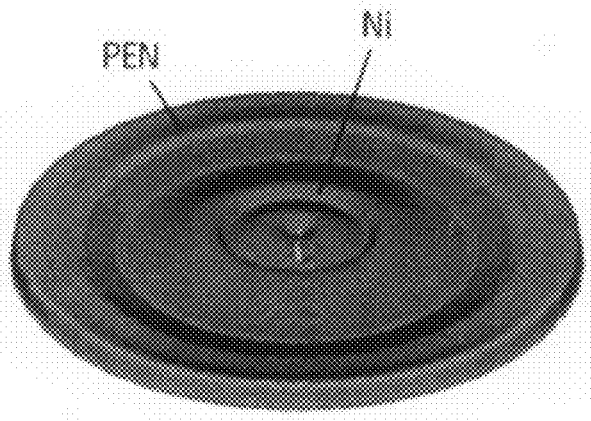
FIG. 15A illustrates a vibrating diaphragm whose topology has been optimized to have a multiplayer structure.
Figure 15B:
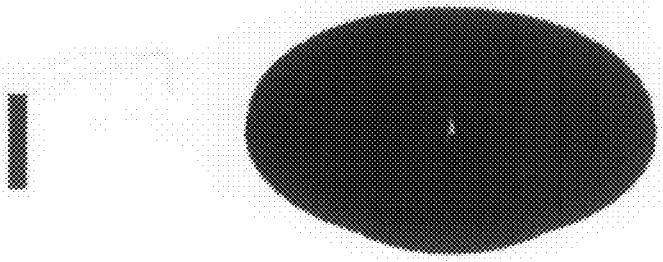
FIG. 15B illustrates a biaxial mode of the vibrating diaphragm when the first natural frequency $f_1$=404.63 Hz.
Figure 15C:
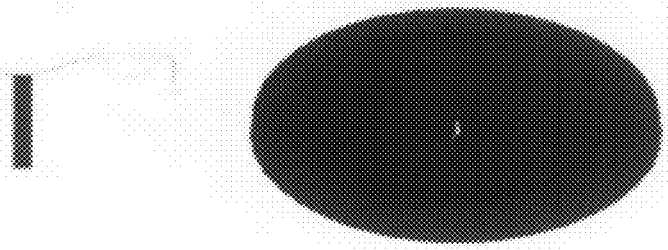
FIG. 15C illustrates a biaxial mode of the vibrating diaphragm when the second natural frequency $f_2$=11300.07 Hz.
Figure 16A:
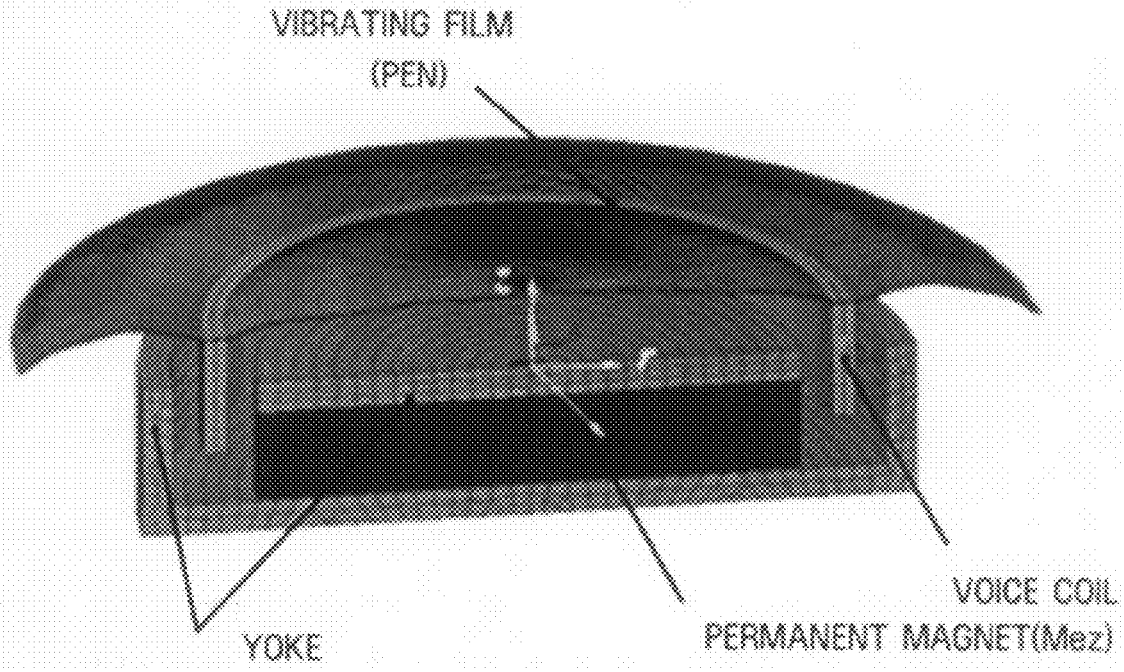
FIG. 16E illustrates a graph comparing frequency ranges and SPLs of a conventional microspeaker (16A), a microspeaker (16B) including a vibrating diaphragm whose shape has been optimized and having a multi-layer structure added with Ni, a microspeaker (16C) including a magnetic circuit whose topology has been optimized and a vibrating diaphragm whose shape has been optimized, and a microspeaker (16D) including a magnetic circuit whose topology has been optimized and a vibrating diaphragm whose shape has been optimized and having a multi-layer structure added with Ni.
Figure 16B:
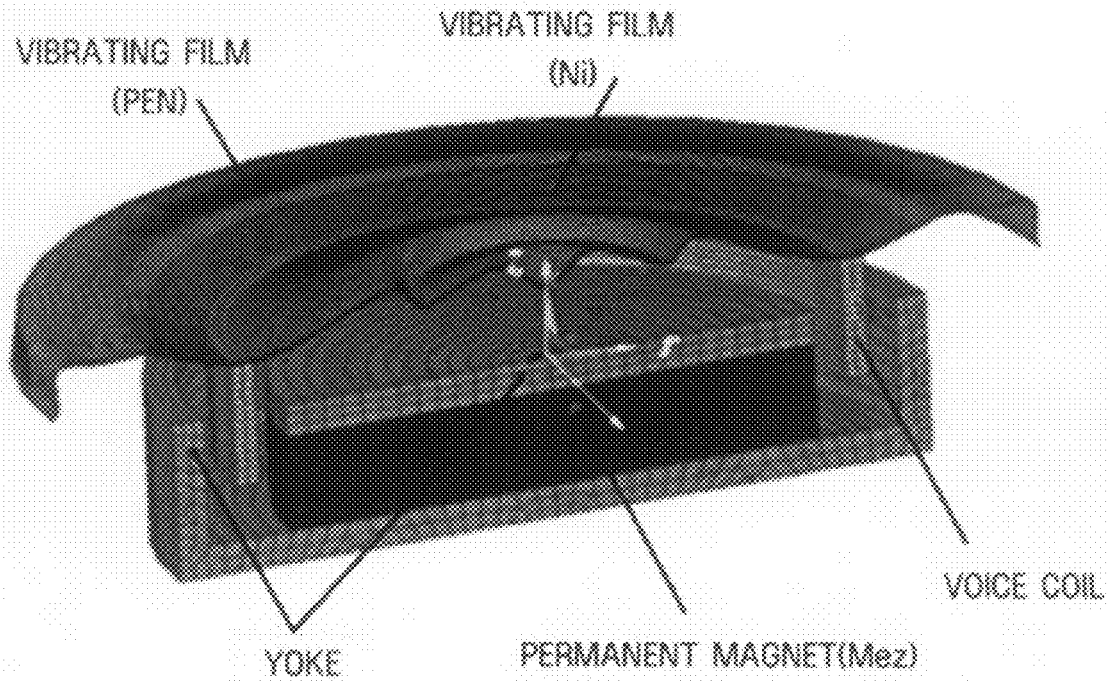
Figure 16C:
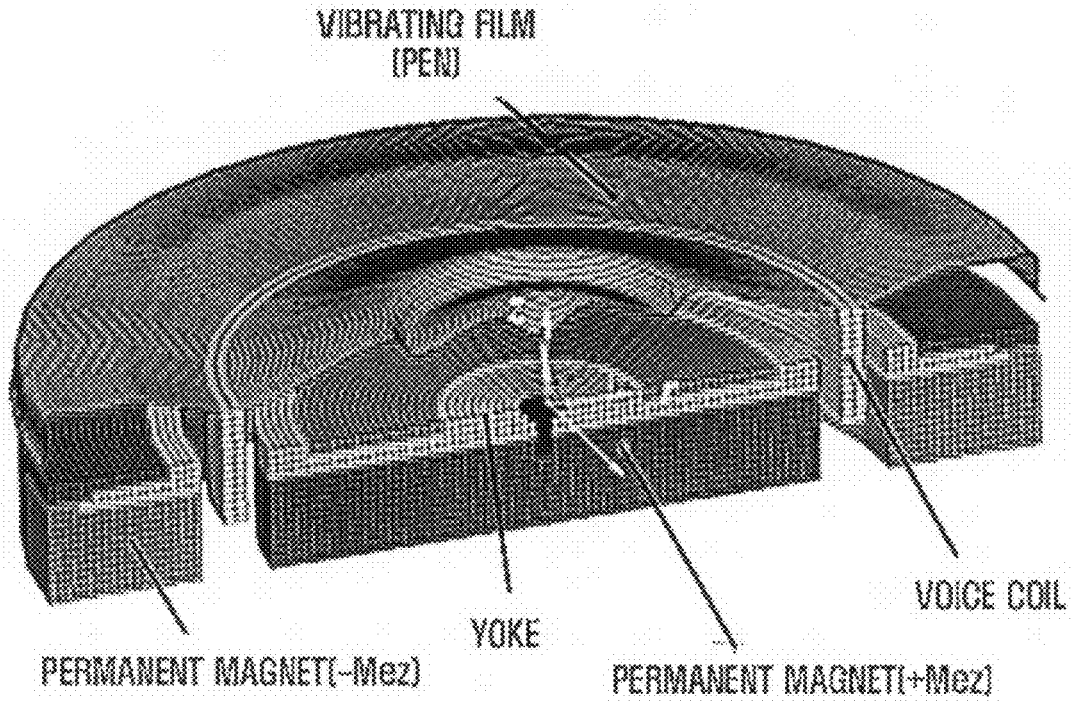
Figure 16D:
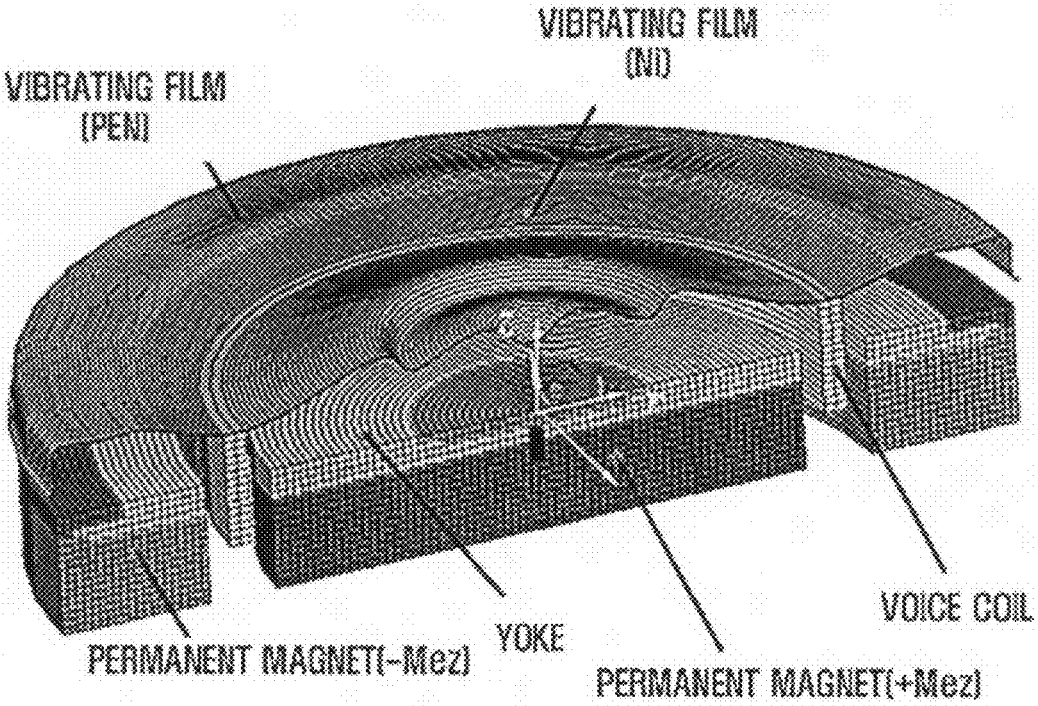
Figure 16E:
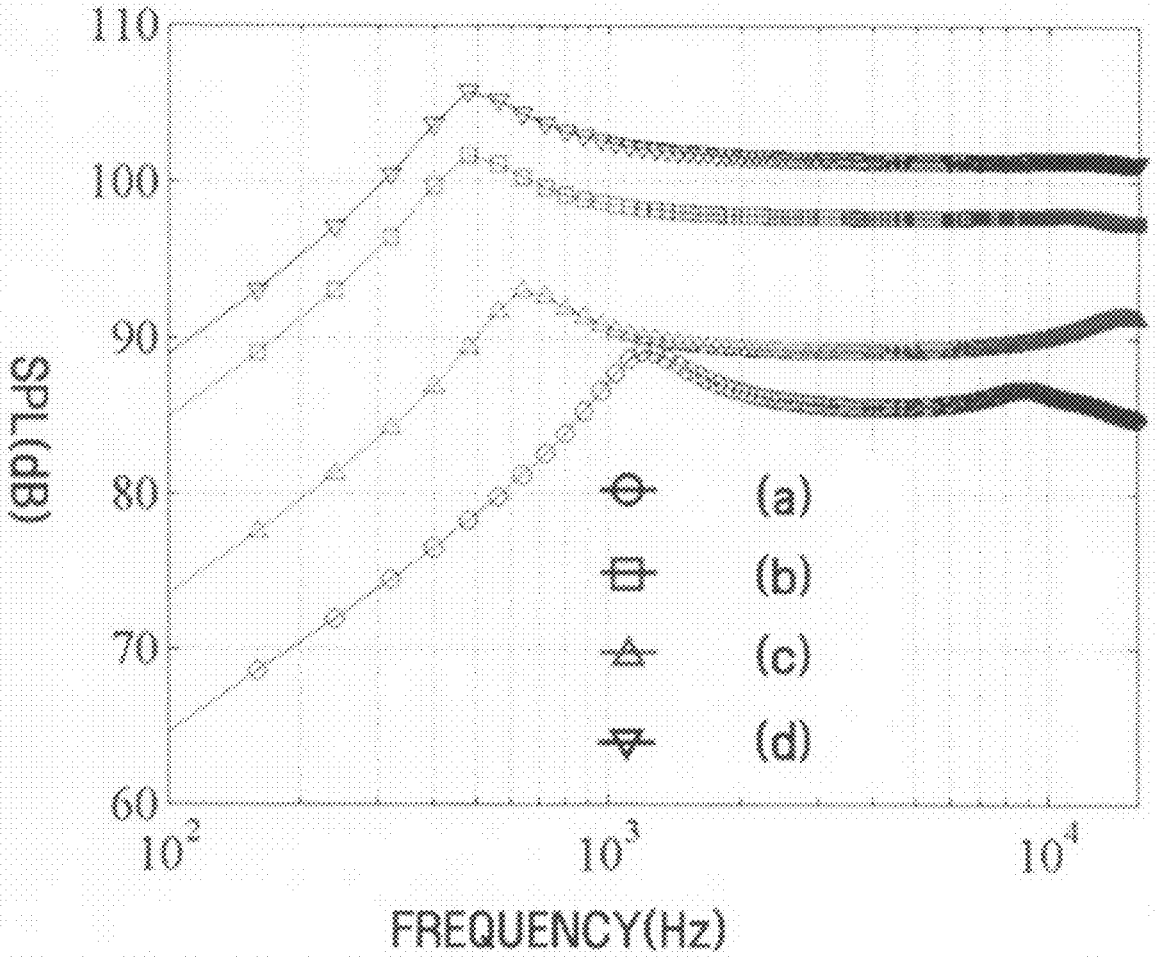

FIG. 15A illustrates a vibrating diaphragm whose topology has been optimized to have a multiplayer structure. FIG. 15B illustrates a biaxial mode of the vibrating diaphragm when the first natural frequency $f_1$=404.63Hz. FIG. 15C illustrates a biaxial mode of the vibrating diaphragm when the second natural frequency $f_2$=11300.07 Hz. FIG. 16E illustrates a graph comparing frequency ranges and SPLs of a conventional microspeaker (16A), a microspeaker (16B) including a vibrating diaphragm whose shape has been optimized and having a multi-layer structure added with Ni, a microspeaker (16C) including a magnetic circuit whose topology has been optimized and a vibrating diaphragm whose shape has been optimized, and a microspeaker (16D) including a magnetic circuit whose topology has been optimized and a vibrating diaphragm whose shape has been optimized and having a multi-layer structure added with Ni.

FIG. 15 illustrates the multi-layered vibrating diaphragm whose topology has been optimized. The following table compares natural frequencies of a conventional microspeaker with those of a microspeaker whose topology has been optimized to have a multi-layer structure including Ni.

| | Model Resonant Frequency (Hz) | |
|---|---|---|
| Mode | Conventional Vibrating Diaphragm | Optimized Vibrating Diaphragm Having Multi-layer Structure |
| $f_1$ (First natural frequency) | 850.60 | 404.63 |
| $f_2$ (Second natural frequency) | 6595.95 | 11300.07 |

Referring to the above table, the frequency range of the vibrating diaphragm having the multi-layer structure that includes Ni is approximately 190% broader than that of the conventional vibrating diaphragm. Referring to FIG. 16, the first natural frequency of the microspeaker (16B) having the multi-layer structure is less than that of the microspeaker (16C) while the SPL of the microspeaker (16B) is higher than that of the microspeaker (16C). As described above, the microspeaker (16D) includes the magnetic circuit whose topology has been optimized and the vibrating diaphragm whose shape has been optimized and has the multi-layer structure added with Ni. Consequently, the SPL and frequency range of the microspeaker (16D) are better than those of the microspeakers (16A) through (16C).

Figure 17:
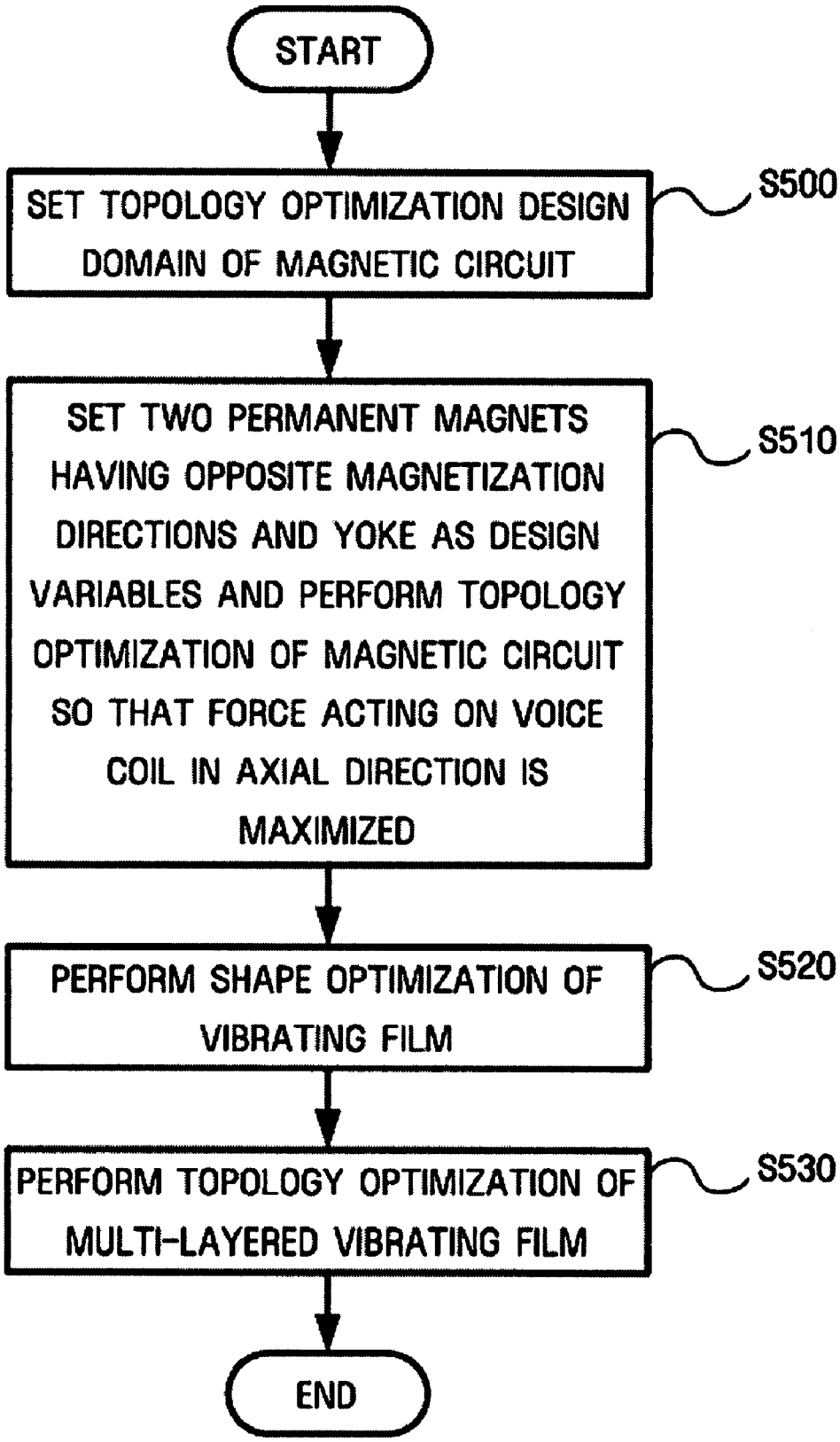
FIG. 17 is a flowchart illustrating a method of designing a microspeaker according to an embodiment of the present invention.

FIG. 17 is a flowchart illustrating a method of designing a microspeaker according to an embodiment of the present invention.

Referring to FIG. 17, a topology optimization design domain of a magnetic circuit, into which a voice coil is inserted, is set (operation S500). Next, two permanent magnets having opposite magnetization directions and a yoke are set as design variables of the design domain. In addition, the topology of the magnetic circuit is optimized such that a force acting on a voice coil in an axial direction can be maximized due to magnetic flux generated by the permanent magnets and electric current that flows through the voice coil (operation S510). Then, the shape of the vibrating diaphragm is optimized (operation S520). The vibrating diaphragm is attached to an end of the voice coil in order to increase the gap between the first and second natural frequencies of a sound field and forms the sound field according to the movement of the voice coil.

The vibrating diaphragm may be formed of PEN or PEI. The vibrating diaphragm may be formed of a ferromagnetic material and have a multi-layer structure. Examples of the ferromagnetic material may include Ni, Fe, and Co.

Next, the topology of the multi-layer structure, which includes the ferromagnetic material, of the vibrating diaphragm is optimized in order to minimize the first natural frequency and maintain the second natural frequency within a predetermined range (operation S530).

As described above, a microspeaker and a method of designing the same according to the present invention provide at least one of the following advantages.

First, a magnetic circuit is designed using multi-polar permanent magnets having different magnetization directions and a yoke, thereby increasing the SPL of a microspeaker.

Second, since the shape of a vibrating diaphragm is optimized in consideration of sound and frequency characteristics, the SPL of the microspeaker can be increased, and frequency bandwidth of the microspeaker can be broadened.

Third, the vibrating diaphragm is formed to have a multi-layer structure including a ferromagnetic material. Therefore, the SPL of the microspeaker can further be increased, and frequency bandwidth of the microspeaker can be broadened.

While the present invention has been particularly shown and described with reference to exemplary embodiments thereof, it will be understood by those of ordinary skill in the art that various changes in form and details may be made therein without departing from the spirit and scope of the present invention as defined by the following claims. The exemplary embodiments should be considered in descriptive sense only and not for purposes of limitation. Therefore, the scope of the invention is defined not by the detailed description of the invention but by the appended claims, and all differences within the scope will be construed as being included in the present invention.

What is claimed is:

1. A microspeaker comprising:

a first permanent magnet and a second permanent magnet disposed on the first permanent magnet with a predetermined gap therebetween, the first and second permanent magnets having opposite magnetization directions;

a third permanent magnet and a fourth permanent magnet disposed on the third permanent magnet with a predetermined gap therebetween, the third and fourth permanent magnets being disposed next to the first and second permanent magnets, respectively, with an air gap therebetween;

a yoke interposed between the first and second permanent magnets and between the third and fourth permanent magnets;

a voice coil inserted into the air gap; and a vibrating diaphragm attached to an end of the voice coil and forming a sound field according to the movement of the voice coil, wherein the first and third permanent magnets have opposite magnetization directions, and the second and fourth permanent magnets have opposite magnetization directions.

2. The microspeaker of claim 1, further comprising another yoke under the first and third permanent magnets.

3. The microspeaker of claim 1, wherein the first through fourth permanent magnets are of a ring type.

4. The microspeaker of claim 1, wherein the vibrating diaphragm is formed of poly ethylene naphtalate (PEN) or polyetherimide (PEI).

5. The microspeaker of claim 1, wherein the vibrating diaphragm is formed of a ferromagnetic material and has a multi-layer structure.

6. The microspeaker of claim 5, wherein the ferromagnetic material is any one of nickel, iron, and cobalt.

* * * * *